United States Patent [19]

Julian

[11] Patent Number: 5,047,785

[45] Date of Patent: Sep. 10, 1991

[54] SPLIT-PHASE TECHNIQUE FOR ELIMINATING PATTERN NULLS FROM A DISCRETE GUARD ANTENNA ARRAY

[75] Inventor: Michael D. Julian, Playa Del Rey, Calif.

[73] Assignee: Hughes Aircraft Company, Los Angeles, Calif.

[21] Appl. No.: 531,185

[22] Filed: May 31, 1990

[51] Int. Cl.[5] ..... H01Q 3/22

[52] U.S. Cl. ..... 342/372

[58] Field of Search ..... 342/372

[56] References Cited

U.S. PATENT DOCUMENTS

| | | | |
|---|---|---|---|
| 3,725,929 | 4/1973 | Spanos | 342/372 |
| 3,731,315 | 5/1973 | Sheleg | 342/372 |
| 4,028,710 | 6/1977 | Evans | 342/372 |
| 4,276,551 | 6/1981 | Williams | 342/372 |
| 4,318,104 | 3/1982 | Enein | 342/372 |

*Primary Examiner*—Thomas H. Tarcza
*Assistant Examiner*—David Cain
*Attorney, Agent, or Firm*—Leonard A. Alkov; Wanda K. Denson-Low

[57] ABSTRACT

A guard for an active antenna array is formed from first and second subarrays of the elements of the antenna, the first and second subarrays each being quadrant symmetric and having respective center phases which are 90 degrees apart. This arrangement greatly reduces nulls in the resultant guard pattern.

17 Claims, 6 Drawing Sheets

| | | |
|---|---|---|
| 1 | j | 1 |
| j | j | j |
| 1 | j | 1 |

| | | |
|---|---|---|
| 1 | j | 1 |
| j | 1 | j |
| 1 | j | 1 |

SPLIT-PHASE TECHNIQUE FOR ELIMINATING PATTERN NULLS FROM A DISCRETE GUARD ANTENNA ARRAY

BACKGROUND OF THE INVENTION

1. Field of the Invention

The subject invention relates to antennas and, more particularly, to a technique for producing a guard pattern for an active antenna array.

2. Description of Related Art

A guard pattern is useful in eliminating target returns outside of the main beam of an antenna. According to conventional design, the guard pattern is designed to exceed the main gain of the antenna in the sidelobe region. Simple decision logic then rejects returns whose main is not much larger than its guard. With a mechanically scanned antenna, one creates a guard pattern by selecting an appropriate guard horn with a fixed orientation to boresight. Such a configuration is effective in all scan directions.

Establishing a guard function is more difficult with an electronically scanned antenna. Since the main beam scans independently of the plate of the antenna, a single, fixed guard horn may not perform well at scans off the mechanical boresight. Two ways around this problem are known. One may either switch strategically between several differently oriented guard horns, or one may use a single guard array which scans with the main beam. The latter single guard array approach is the subject of the invention described hereafter.

A simple single guard subarray can be formed on an active array antenna by devoting one or more elements to this function. However, one element alone cannot be scanned because scanning requires a phase slope across the antenna. Two elements together can only scan in one angular dimension. Since the single guard subarray needs to scan omnidirectionally, it would appear to require four-fold symmetry. Thus, the smallest practical single guard array consists of four elements in a square. The next largest square guard array has nine elements arranged three-by-three.

The problem with such small guard arrays is the presence of excessive nulls in the guard array pattern. In the vicinity of nulls, the guard is generally useless. The square arrays described above have entire null planes which move as the guard array is scanned. Such null planes lead to unacceptable performance.

SUMMARY OF THE INVENTION

Accordingly, it is an object of the invention to improve active antenna arrays;

It is another object of the invention to provide an improved guard technique for an active antenna array; and It is another object of the invention to eliminate excessive nulls in guard arrays associated with an active antenna array.

According to the invention, a guard pattern is formed using a small subarray of an active array. Nulls are eliminated by forming the small subarray into two quadrant symmetric subarrays and placing a 90-degree phase shift between the center phases of the two quadrant symmetric subarrays.

As an example, one may take the guard array as a $3\times3$ matrix of elements. Two quadrant symmetric guard subarrays are then formed: the four elements in the corners of the matrix comprise one guard subarray, and the five remaining elements comprise the other. A 90-degree phase shift is placed between the center phases of the two guard subarrays by putting unit real weights (w=1) on one subarray and unit imaginary weights (w=j) on the other. The entire nine element guard array is then scanned with the main beam. Guard nulls can only occur when both guard subarrays have a null in the same direction and at the same scan. This situation occurs at only a small number of points.

DETAILED DESCRIPTION OF THE PREFERRED EMBODIMENTS

The following description is provided to enable any person skilled in the art to make and use the invention and sets forth the best modes contemplated by the inventor for carrying out his invention. Various modifications, however, will remain readily apparent to those skilled in the art, since the generic principles of the present invention have been defined herein specifically to provide a particularly useful and readily implementable guard array scheme for an active antenna array.

Figure 1:
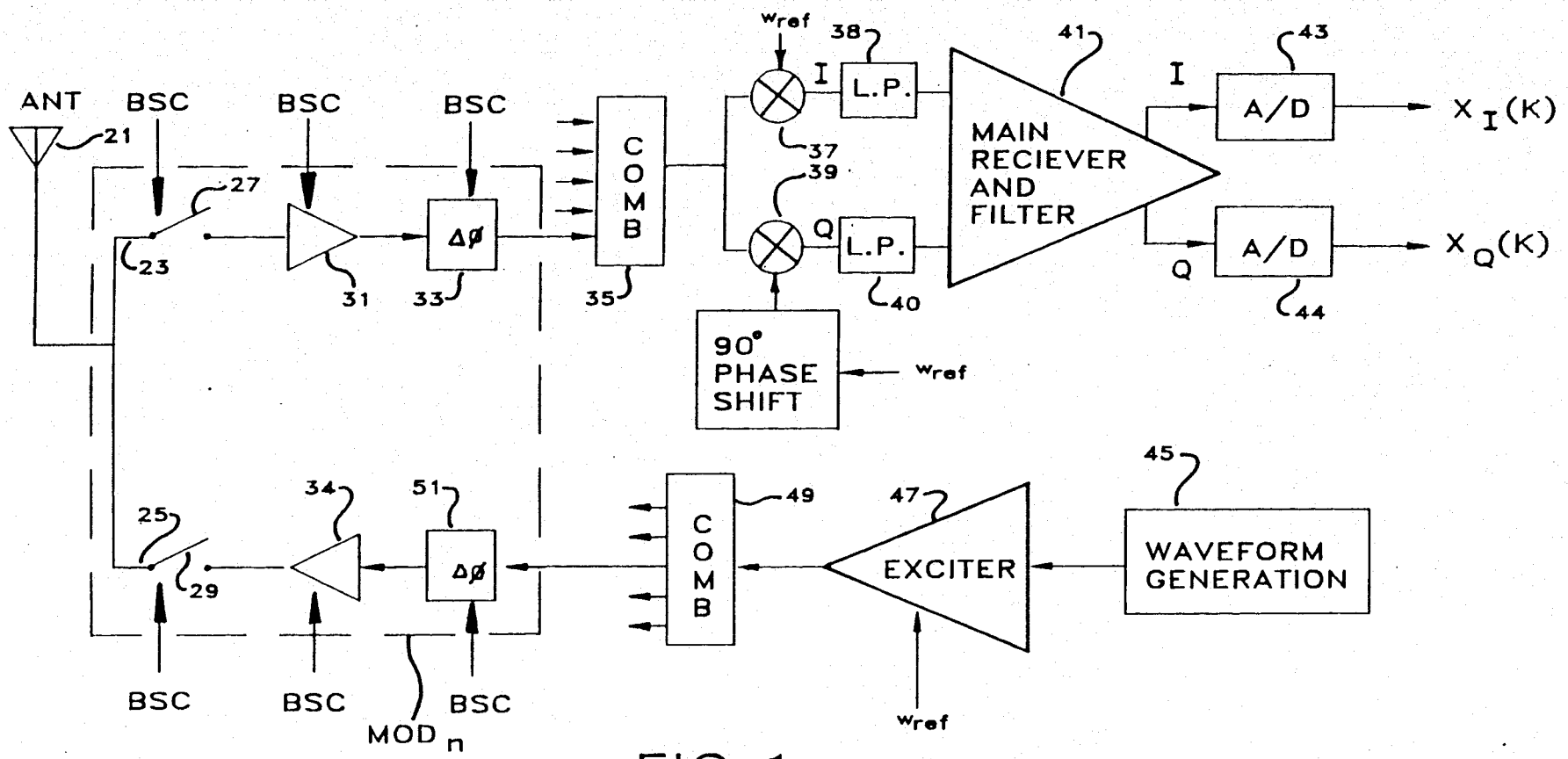
FIG. 1 is a schematic block diagram illustrative of typical active antenna array elements.

FIG. 1 illustrates a typical element MODn of an active antenna array. In this element MODn, an antenna element 21 is connected to both a receive path 23 and a transmit path 25. Respective switches 27, 29 are placed in the receive path 23 and transmit path 25 to alternately connect the antenna 21 to either a low noise input amplifier (LNA) 31 or a power output amplifier 34. As indicated, closing of the switches 27, 29 is under control of a beam steering computer BSC, as is the gain of each of the amplifiers 31, 34.

The LNA 31 outputs to a receive phase shifter 33, which supplies a phase shifted output signal or pulse IQ to an analog combining network 35. The amount of phase shift is selected by the BSC 13 and is typically applied through a series of phase increments, numbering, for example, 32. The combining network 35 receives the outputs of each phase shifter 33 of all the other elements of the array and adds the RF signals together. The output voltage of the combining network 35 is mixed by respective mixers 37, 39 with a reference oscillator signal at a reference frequency $\omega_{ref}$ and the same signal $\omega_{ref}$ shifted in phase by 90 degrees, thereby forming in-phase and quadrature outputs I, Q. These outputs I, Q are filtered by respective low pass filters 38, 40 and supplied to a main receiver and filter 41 which outputs analog signals to first and second A/D converters 43, 44. Each A/D converter 43, 44 samples its input to produce a succession of IQ samples $x_O(k)=x_I(k)+jx_Q(k)$. Those skilled in the art will appreciate that the digitized signal $x_0(k)$ represents a signal where a relatively nonmoving target in the environment (zero doppler) produces a DC signal.

On the transmit side of the element MODn, the power amplifier 34 is supplied with an input signal generated as follows. A waveform generator 45 generates a waveform which is supplied to an exciter 47. The exciter 47 supplies an RF signal synched to the reference oscillator frequency and outputs to a combiner 49. The combiner 49 distributes low level RF energy to all the elements, including transmit phase shifter 51 and the phase shifters of the other elements. The phase shifter 51 imparts a phase shift selected by the BSC 13 to its input signal and supplies the phase shifted signal to the input of the power amplifier 34.

On transmission, an element MODn takes exciter power, amplifies it, shifts the phase, and then radiates. On receive, the process is reversed. The received energy is amplified, phase shifted, then sent to the receiver 41.

Figures 2, 5, 6:
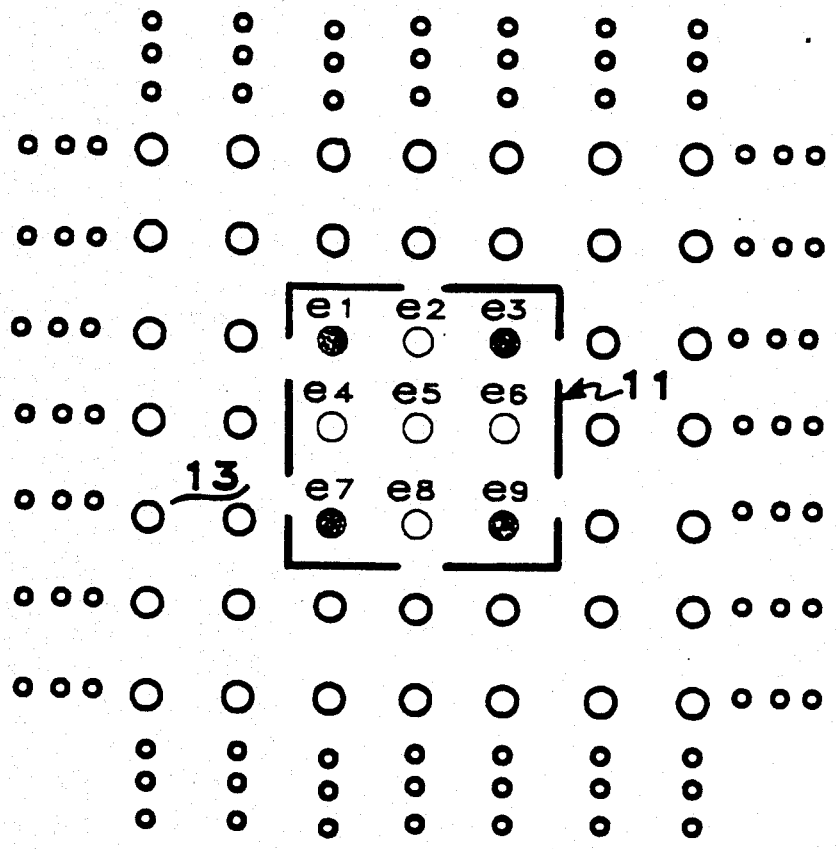
FIG. 2 is a schematic diagram of an active antenna array incorporating the preferred embodiment of the invention.
FIGS. 5 and 6 illustrate first and second weighting configurations.

FIG. 2 illustrates an example guard array 11, formed as a subarray containing elements $e_1$, $e_2$, $e_3$, $e_4$, $e_5$, $e_6$, $e_7$, $e_8$, $e_9$ of an active antenna array 13. In the context of guard nulls per se, the guard antenna could be located anywhere on the main array 13. However, to minimize distortion of the main pattern formed from the remaining elements, the guard is typically at an edge of the array 13. The reason for such placement is that the main channel is typically amplitude weighted with low intensities at the edge—thus, a disturbance here causes little problem.

The elements $e_1, e_2 \ldots e_9$ of the guard array 11 shown in FIG. 2 form a $3\times3$ square matrix. The $3\times3$ square matrix is further subdivided into a first guard subarray containing the four corner guard array antenna elements $e_1$, $e_3$, $e_7$, $e_9$ (shaded) and a second guard subarray containing the remaining guard array antenna elements $e_2$, $e_4$, $e_5$, $e_6$, $e_8$. The subarrays $e_1 \ldots e_9$; $e_2 \ldots e_8$ are further given quadrant symmetry, i.e., the amplitude weights $w_k$ associated with elements at $\pm x$ and $\pm v$ positions are identical, as discussed in mathematical detail hereafter.

Further according to the preferred embodiment, a 90-degree phase shift or difference is placed between the center phases of the first and second subarrays $e_1$, $e_3$, $e_7$, $e_9$; $e_2$, $e_4$, $e_5$, $e_6$, $e_8$, respectively. The center phase is the effective phase at the geometrical center of the subarray, even if no element exists there. The actual element phases are set to values producing the desired phase slope across the subarray.

The 90-degree phase shift between the respective center phases of the first and second arrays is achieved by putting unit real weights ($w=1$) on one subarray and unit imaginary weights ($w=j$) on the other. Ordinarily, there is a separate receiver for each of the main and guard arrays. Such a receiver may include a combiner such as combiner 35 for combining (adding) the received guard array element voltage signals, as well as receiver circuitry following the combiner, to IQ detect the guard channel signal, as shown in FIG. 1. Before the voltages from the nine guard elements $e_1 \ldots e_9$ are added together by the combiner to form the guard signal, a 90-degree phase shift is added to the voltage signal received by each of the elements of one subarray, e.g., $e_1$, $e_3$, $e_7$, $e_9$, for example, by a microwave device or by using element phase shifters such as the phase shifter 33 of FIG. 1.

With the appropriate quadrant symmetry and center phase difference having been set up, the entire nine element guard array 11 is then scanned with the main beam. Under the circumstances, guard nulls can only occur when both guard subarrays have a null in the same direction and at the same scan. This situation occurs at only a small number of points, thus substantially eliminating problems caused by nulls discussed above. It may be noted that all elements are effectively scanned simultaneously. Data is ordinarily not collected during element transition.

A technical rationale for the elimination of nulls as described may be set forth as follows. If the distribution of radiators, e.g., $e_1 \ldots e_9$ in an array such as that shown in FIG. 2 has quadrant symmetry, then the phase of the resultant voltage is the same, independent of look and scan angles. Since each of the two guard subarrays of array 11 has such quadrant symmetry, then one may be taken as pure real and the other as pure imaginary (90-degree phase difference). Thus, the composite guard power, which is the sum of the real and imaginary components squared, can only be zero if both guard subarrays have nulls.

Let ni and si be the respective unit vectors in the look and scan directions. Take a coordinate system such that the antenna lies in the x-y plane with the z axis along mechanical boresight. Let n and s be the respective projections of ni and si onto the x-y plane. The voltage V at a particular direction is given by the phase summation over the antenna surface, incorporating the weights $w_k$ at position $x_k$ with wavelength $\lambda$.

$$V(n-s) = \sum_k w_k \exp[2\pi j\, x_k \cdot (n-s)/\lambda] \tag{1}$$

Equation (1) can be rewritten in terms of its x and y components as:

$$V(n-s) = \sum_k w_k \exp\{2\pi j\, [x_k(n_x - s_x) - y_k(n_y - s_y)]/\lambda\} \tag{2}$$

For the postulated quadrant symmetry, the weights $w_k$ are identical at $\pm x$ and $\pm v$ positions. Thus, the complex exponentials can be turned into ordinary trig functions.

$$V(n-s) = 4 \sum_{k/4} w_k \cos[2\pi\, x_k(n_x - s_x)/\lambda] \cos[2\pi\, y_k(n_y - s_y)/\lambda] \tag{3}$$

The k/4 in Equation (3) indicates a summation over only the first quadrant ($x \geqq 0$, $y \geqq 0$).

If the weights in Equation (3) are real, then so is V for all scan and look directions. This proves the claim that quadrant symmetry implies phase invariant patterns. Hence, the two guard subarrays of array 11 each maintain the phases of their respective pattern voltages, independent of scan and look angle changes. Because these voltages are 90 degrees out of phase, one may be considered pure real and the other pure imaginary. Clearly, guard nulls occur only at simultaneous nulls of the subarrays.

A great simplification occurs in the understanding and design of antenna patterns if one uses a cosine space representation. This simply means that instead of directly using look and scan angles, one uses the sine or cosine of these angles. In fact, a cosine space representation can be easily constructed by projecting unit vectors for the look and scan directions onto the x-y plane. The vectors n and s of Equation (1) were devised precisely for this purpose.

The magnitudes of n and s are bounded by one. Hence, the magnitude of their difference is bounded by two. This means that cosine space only needs to be specified within a radius of two around the origin. These ideas will become more apparent with some examples.

Figure 3:
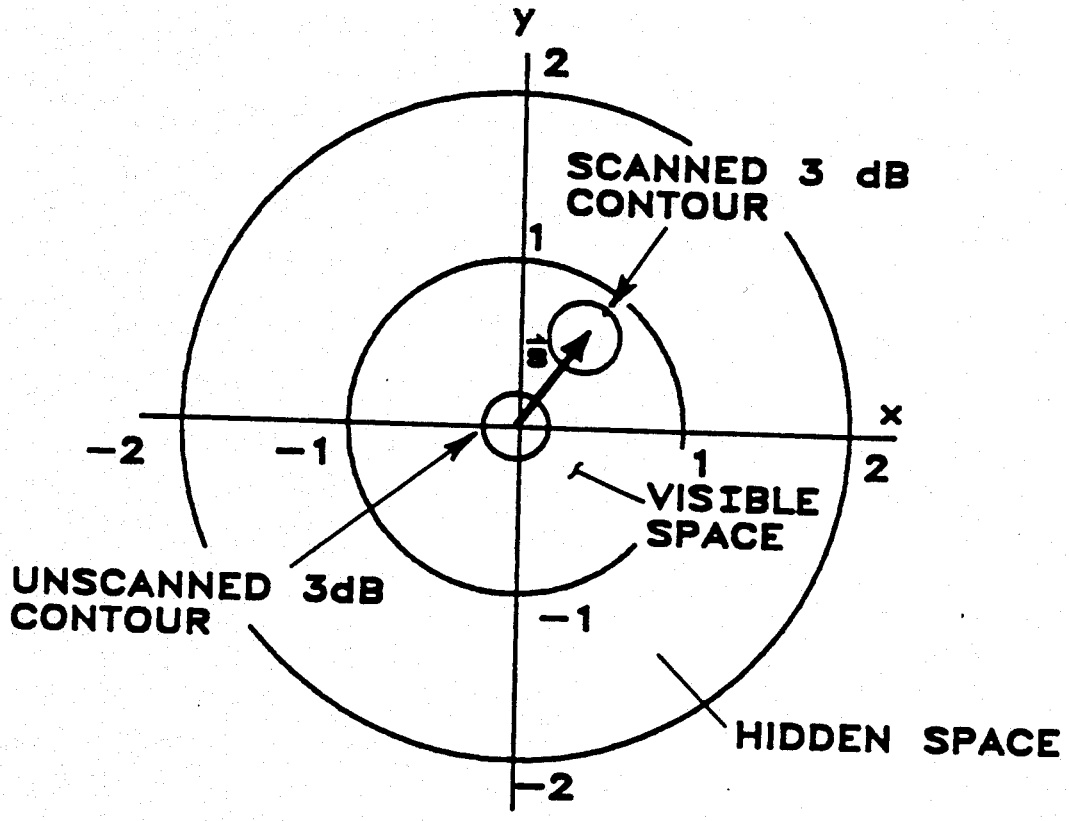
FIG. 3 is a graph illustrating cosine space.

Referring to FIG. 3, consider the 3-dB contour of an unscanned pattern. It is a circle around the origin in cosine space for a circularly symmetric antenna. This circle is defined by the equation:

$$V(n)=C_3 \tag{4}$$

This is understood to be the set of all points in cosine space traced out by n such that Equation (4) is satisfied. Here $C_3$ is a constant equal to the 3-dB pattern voltage. The V in Equation (4) is, of course, given by Equation (1). The vector s is zero in the unscanned case.

Now imagine that the beam is scanned away from the origin by some scan vector s. From Equation (1), the 3-dB contour of the scanned pattern is given by:

$$V(n-s)=C_3 \tag{5}$$

Since Equation (4) defined a circle around the origin in cosine space, then Equation (5) defines a circle centered at the position of vector s. Thus, when a beam is scanned, its cosine space projection is simply translated by the scan vector, as shown in FIG. 3.

Figure 4:
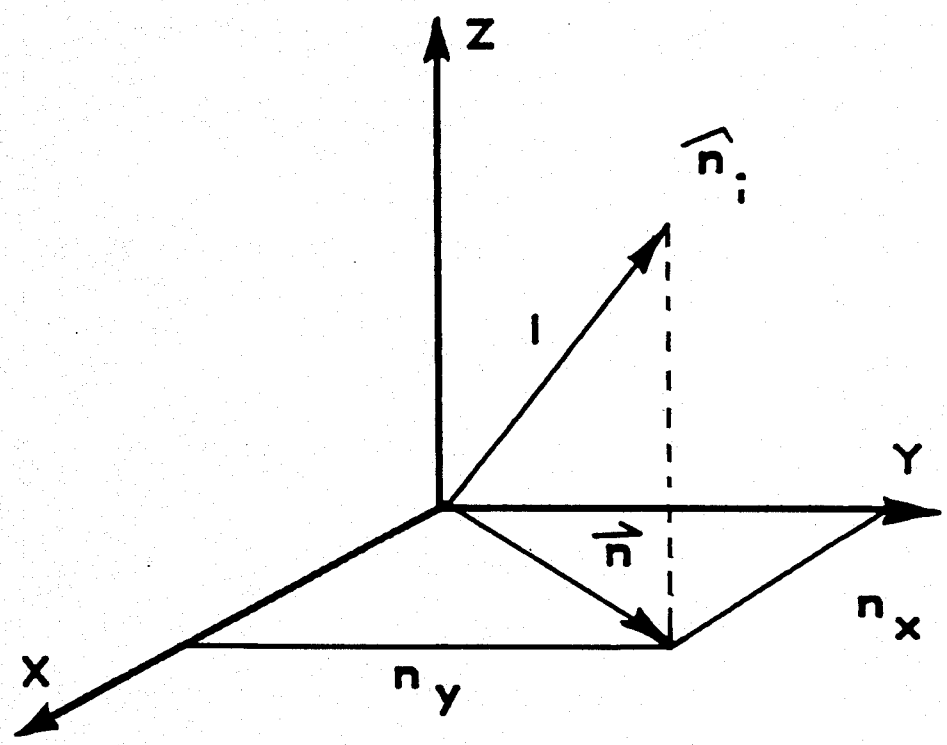
FIG. 4 is a graph illustrating mapping between points in cosine space and a direction vector in three-dimensional space.

Cosine space includes both visible and hidden space. The unit circle around the origin comprises visible space. Every point in visible space can be mapped back into a direction in normal three-dimensional space by simply drawing a line from the point parallel to the +z axis until it intersects a unit sphere centered at the origin. The unit vector defined by a line drawn from the origin to the intersection point on the sphere is the corresponding direction vector in space. Conversely, each direction vector in three-dimensional space maps into a point in visible cosine space, as illustrated in FIG. 4. The three-space components of the direction vector ni are easily specified analytically in terms of the cosine space projection vector D: The x and y components are the same; the z component follows easily by noting that ni has unit length.

$$ni_x = n_x \tag{6}$$

$$ni_y = n_y$$

$$ni_z = \sqrt{(1 - n_x^2 - n_y^2)}$$

The spatial angle corresponding to the direction vector ni can be found by expressing ni in polar coordinates.

It should also be noted that this transformation from cosine space to angles in three-space causes the beam to broaden asymmetrically with scans off boresight. Cosine space, however, has undistorted beam contours.

All points in cosine space outside of the unit circle form the so-called hidden space. Points in this part of cosine space only impact three-dimensional space if the beam is scanned. One may view the scanning process as a translation of the entire cosine space, including the hidden part, by an amount given by the scan vector. That is, all the nulls and contours move in the direction of the scan vector. It is assumed that the origin is kept fixed during the translation. Thus, since the visible part of cosine space is inside a unit circle around the origin, which has not moved, then some points that were visible are now hidden, and some points which were hidden are now visible. Furthermore, since the magnitude of the scan vector is no greater than one, the only significant part of hidden space is within a radius of two when the beam lies along mechanical boresight.

As stated earlier, ordinarily, null planes are a problem for a small discrete array. This is easily shown. Assume for concreteness that the element spacing is $\lambda/2$.

If the entire nine-element guard array were weighted uniformly (w=1), then from Equation (3) the unscanned voltage is:

$$\begin{aligned} V &= 4[.25 + .5\cos(\pi n_x) + .5\cos(\pi n_y) + \cos(\pi n_x)\cos(\pi n_y)] \\ &= [1 + 2\cos(\pi n_x)][1 + 2\cos(\pi n_y)] \end{aligned} \tag{7}$$

Clearly the V in Equation (7) is zero if either cosine term is −0.5. Thus, the null planes within a two-unit circle are given by:

$$n_x \pm 2/3,\ \pm 4/3$$

or $$n_y \pm 2/3,\ \pm 4/3 \tag{8}$$

Figure 7:
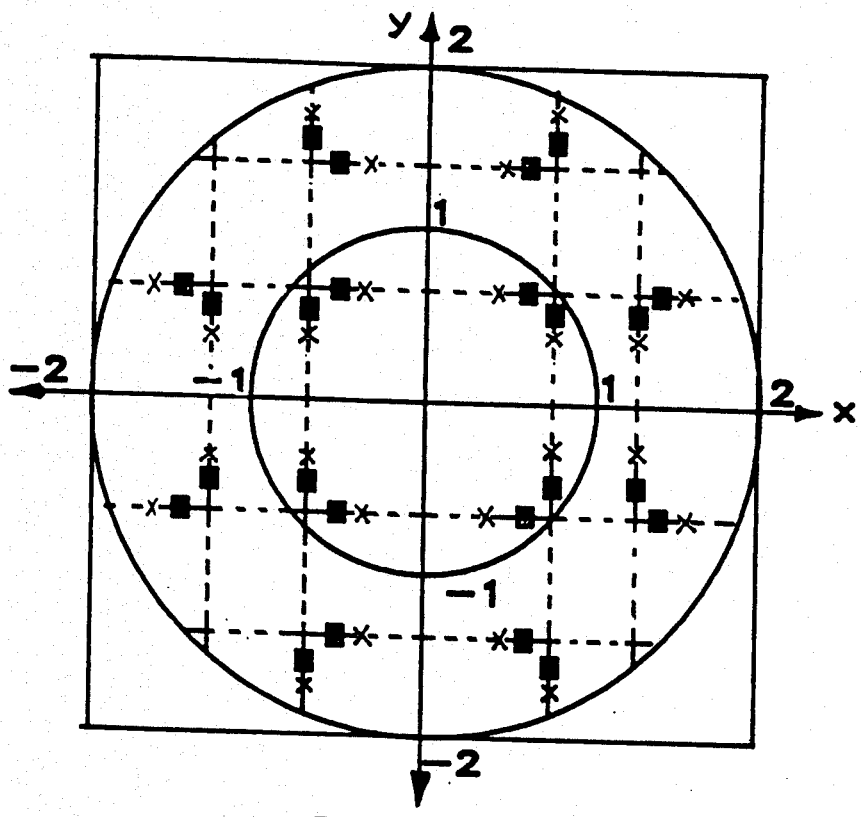
FIG. 7 is a graph illustrating null patterns associated with selected guard arrays.

The null planes depicted in Equation (8) are represented by the dotted lines in FIG. 7.

FIG. 5 shows the weighting structure of the nine-element guard array 11. The real subarray is taken as the four corner elements $e_1$, $e_3$, $e_7$, $e_9$, with the rest as the imaginary array. Let the corresponding pattern voltages be denoted by $V_c$ and $V_r$. From Equation (3) these voltages are given by:

$$V_c = 4\cos(\pi n_x)\cos(\pi n_y)$$

$$V_r/j = 1 + 2[\cos(\pi n_x) + \cos(\pi n_y)] \tag{9}$$

The only way for simultaneous nulls to occur in both $V_c$ and $V_r$ is for either the x or y cosine term to be zero while the other one is −0.5. There are 24 solution points, $(n_x, n_y)$, in the two-unit circle of cosine space:

$$(\pm 1/2, \pm 2/3), (\pm 1/2, \pm 4/3), (\pm 3/2, \pm 2/3), \tag{10}$$

$$(\pm 2/3, \pm 1/2), (\pm 4/3, \pm 1/2), (\pm 2/3, \pm 3/2)$$

There is an alternate configuration of real and imaginary weights of the nine-element guard array 11 that maintains separate symmetry of the real and imaginary subarrays. This second configuration is shown in FIG. 6. In this embodiment, the center element $e_5$ is simply included with the four corner elements $e_1$, $e_3$, $e_7$, $e_9$. The corresponding subarray voltages are given by:

$$V_c' = 1 + 4\cos(\pi n_x)\cos(\pi n_y)$$

$$V_r'/j = 2[\cos(\pi n_x) + \cos(\pi n_y)] \tag{11}$$

The only way for $V_c'$ and $V_r'$ to be simultaneously zero is for either the x or y cosine term to be $\frac{1}{2}$ and the other to be its negative. There are 24 solution points, $(n_x, n_y)$, in the two-unit circle of cosine space:

$$(\pm 1/3, \pm 2/3), (\pm 1/3, \pm 4/3), (\pm 5/3, \pm 2/3), \quad (10)$$
$$(\pm 2/3, \pm 1/3), (\pm 4/3, \pm 1/3), (\pm 2/3, \pm 5/3)$$

The nulls for the first and second configurations of FIGS. 5 and 6 are plotted in FIG. 7 and represented by black squares and X's, respectively. For the nonscanned beam, there are eight nulls visible for each configuration. However, the nulls for the configuration of FIG. 5 are slightly farther away from the origin and, hence, may be less troublesome than those of the configuration shown in FIG. 6. This suggests that the configuration of FIG. 5 is the proper weighting scheme to use.

The nulls in the hidden space annulus between radii 1 and 2 may shift in as the beam is scanned. With Configuration 1, it appears that small scans have fewer nulls since those in visible space shift out before those in hidden space come in.

A comparison between the points and dotted lines in FIG. 7 shows the enhancement due to the technique of phase shifted subarrays. An infinite set of nulls has been reduced to a few points.

The guard subarrays each have an infinite number of nulls. However, as demonstrated above, the composite guard array 11 produces a pattern with a finite number of isolated nulls. This is clearly a vast improvement, but it is not complete justification of the selected guard array 11.

One must also compare the ability of the guard to cover the main and the sidelobes. FIGS. 8 through 11 illustrate various main and guard configurations with electronic scanning. That is, both the main and guard arrays are scanned in the same direction. The main array is a 26-inch square with 35-dB circular Taylor (n=4) amplitude weights. The element spacing was half wavelength with $\lambda=0.1$ ft. The total number of elements was 1,892. In FIGS. 8–11, the main receive pattern is indicated by a solid line 201, the guard pattern by a uniform small dash pattern 203, the imaginary component (j) by a dot-dash pattern 205, and the real component (i) by a larger dash pattern 207.

Two fundamental effects are investigated: possible degradation of the main pattern caused by removing the nine elements forming the guard, and the proper sidelobe coverage of this new main by the co-scanning guard. Since the main array contains thousands of elements, its pattern suffers a negligible change. The pattern coverage issue requires more care.

As a check, a null was selected from FIG. 7 and a cut through the corresponding pattern was made. The point selected was $(\frac{2}{3}, \frac{1}{2})$. The polar coordinates are computed by noting that:

$$\phi=\tan^{-1}(n_y/n_x)$$
$$\theta=\sin^{-1}[\sqrt{(n_x^2+n_y^2)}] \quad (13)$$

Figure 8:
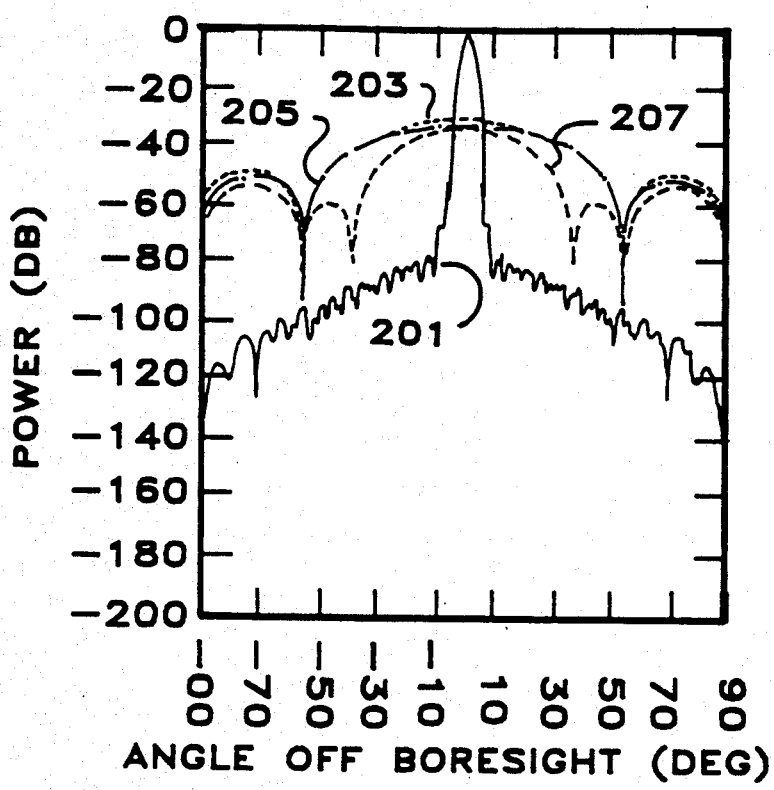
FIGS. 8–11 illustrate cuts of guard patterns generated according to the preferred embodiment.

Equation (13) implies that $\phi=36.87$ degrees and $\theta=56.44$ degrees. Thus, if a 36.87-degree cut is taken, then the null should occur within this cut at 56.44 degrees off boresight, as shown in FIG. 8. The null prediction is satisfied. The 0-degree reference is, of course, parallel to the side of the guard array 11 along the x axis.

Figure 9:
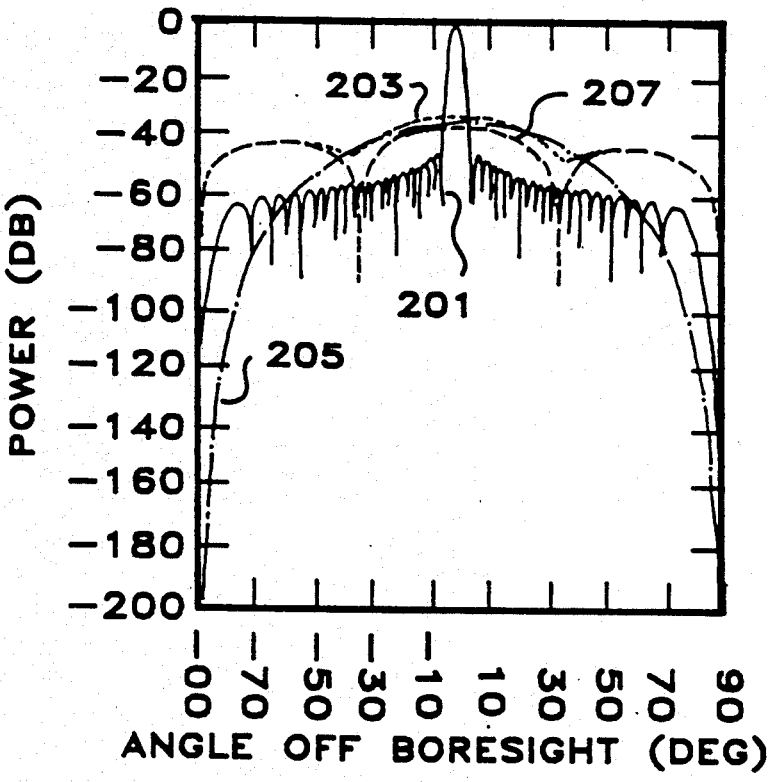

FIG. 9 depicts an unscanned 0-degree cut through the pattern produced by the configuration of FIG. 6. It shows both the main and guard patterns. The guard subarray patterns are shown along with the composite to provide an indication of how the nulls are mutually filled in. The remaining patterns are all from the preferred configuration of FIG. 5.

Figure 10:
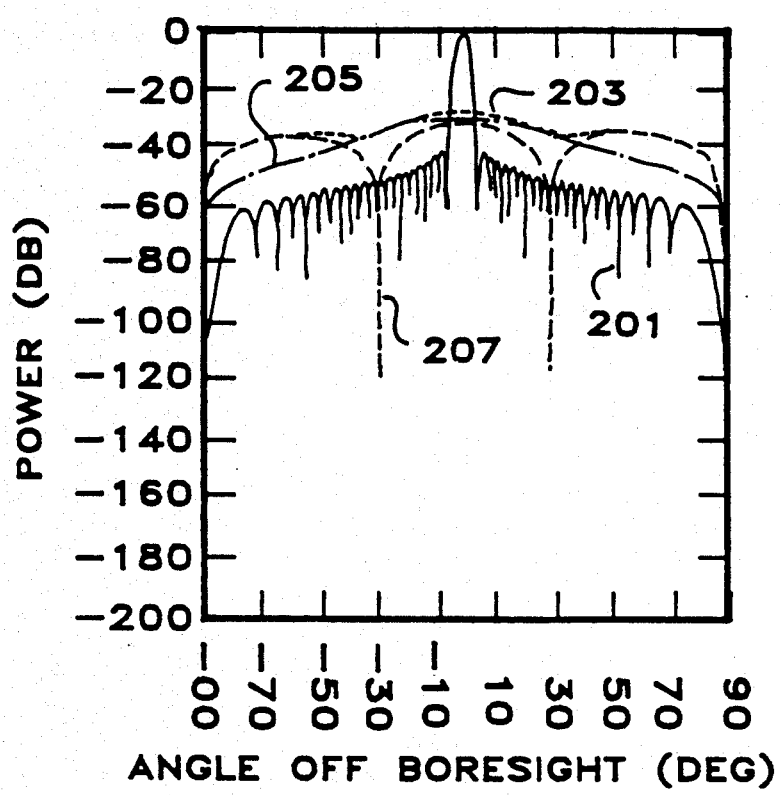

FIG. 10 is the unscanned 0-degree cut for the configuration of FIG. 5. It is comparable to FIG. 9, but just slightly better.

Figure 11:
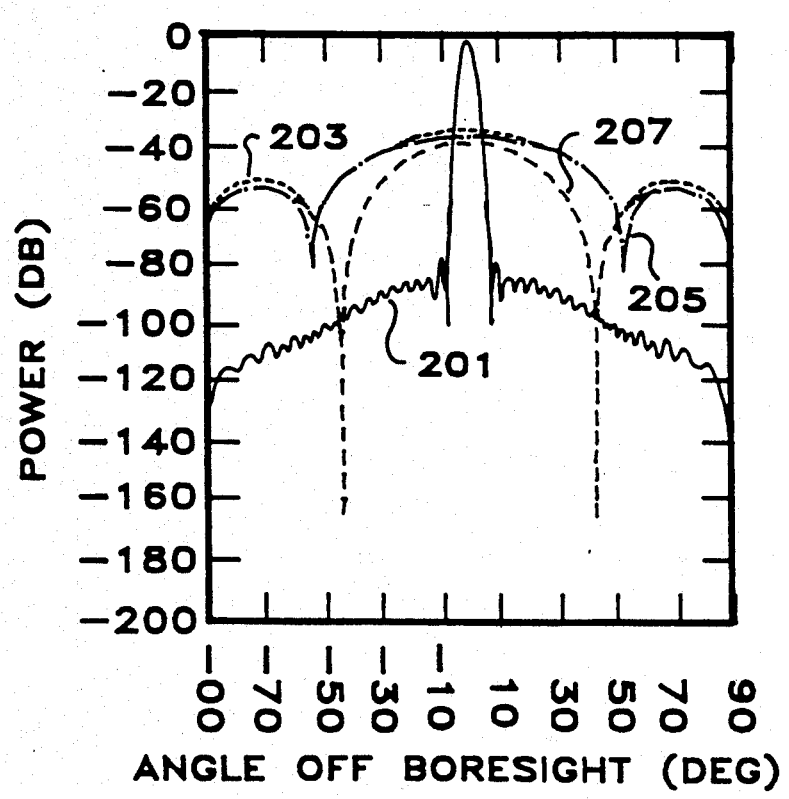

FIG. 11 shows a 45-degree cut and 0-degree scan angle. The main sidelobes are mostly covered in each. Sometimes the nulls of the subarrays are close together as in FIG. 11. However, the composite effect still eliminates the overall null.

In summary, the concept of two quadrant symmetric subarrays, 90 degrees out of phase with each other, greatly alleviates the nulling problem. The preferred element configuration for a 3×3 matrix array, for example, is the corner elements forming one subarray, and the remaining elements forming the other.

Those skilled in the art will appreciate that element configurations other than a 3×3 matrix or square array may be used to create a guard according to the principles of the invention, for example, such as rectangular, circular, or oval, as long as such configurations provide quadrant symmetry. In general, those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A guard for an active antenna array, said array comprising a plurality of antenna elements, said guard comprising:

a selected subarray of the elements of said antenna array, the elements of said selected subarray being allocated to first and second guard subarrays, each of the first and second guard subarrays having a physical center, each element of each of said first and second guard subarrays further having a phase and a weight associated therewith, the weight being selected for application to the signal received by the respective element, the weights associated with the elements of the first guard subarray being selected to exhibit quadrant symmetry with respect to one another, the weights of the second guard subarray being selected to exhibit quadrant symmetry with respect to one another; and means for establishing a 90-degree phase difference between the phase of the received signal at the physical center of said first guard subarray and the phase of the received signal at the physical center of said second guard subarray.

2. The guard of claim 1 wherein said selected subarray comprises a matrix of elements.

3. The guard of claim 2 wherein said matrix is a square matrix.

4. The guard of claim 1 wherein said selected subarray comprises a matrix of elements and said first guard subarray comprises the corner elements of said square subarray.

5. The guard of claim 4 wherein said matrix is a square matrix.

6. The guard of claim 2 wherein said matrix is a 3×3 square matrix and wherein said first guard subarray comprises the four corner elements of said square matrix and the second guard subarray comprises the remaining elements.

7. The guard of claim 2 wherein said matrix is a $3\times3$ square matrix and wherein said first guard subarray comprises each corner element of said matrix and the center element of said matrix and wherein said second guard subarray comprises the remaining elements of said matrix.

8. The guard of claim 1 wherein said means for establishing comprises phase shifter means for shifting the phase of the signal received by each respective element of said first guard subarray.

9. The guard of claim 6 wherein said means for establishing comprises phase shifter means for shifting the phase of the signal received by each respective element of said first guard subarray.

10. The guard of claim 7 wherein said means for establishing comprises phase shifter means for shifting the phase of the signal received by each respective element of said first guard subarray.

11. The guard of claim 1 wherein said plurality of antenna elements is arrayed in a rectangular matrix, and wherein said guard is disposed at the edge of said antenna array.

12. A method of generating a guard pattern for an active antenna array, said array comprising a plurality of antenna elements, said method comprising the steps of:

apportioning a subarray of elements of said array into first and second guard subarrays, each of the first and second guard subarrays having a physical center, each element of said first and second guard subarray further having a phase and a weight associated therewith, the weight being applied to the signal received by the respective element;

selecting the weights associated with the elements of the first guard subarray to exhibit quadrant symmetry with respect to one another;

selecting the weights of the second guard subarray to exhibit quadrant symmetry with respect to one another; and establishing a 90-degree phase differential between the phase of the received signal at the physical center of said first guard subarray and the phase of the received signal at the physical center of said second guard subarray.

13. The method of claim 12 wherein said step of apportioning comprises the step of selecting a matrix of elements to comprise said subarray.

14. The method of claim 12 wherein said step of establishing comprises the step of shifting the phase of the respective signals received by each element of said first guard subarray by 90 degrees.

15. The method of claim 13 wherein said step of establishing comprises the step of shifting the phase of the respective signals received by each element of said first guard subarray by 90 degrees.

16. A method of generating a guard pattern for an active antenna array, said array comprising a plurality of elements, each said element including a means for applying a weight to the received signal, said method comprising the steps of:

selecting a subset of the elements of said array to form a guard subarray; and allocating purely real weights to a first set of the elements of said guard subarray and purely imaginary weights to the elements of said guard subarray which are not members of said first set.

17. A guard for an active antenna array, said array comprising a plurality of antenna elements, said guard comprising:

a selected subarray of the elements of said antenna array, the elements of said selected subarray being allocated to first and second guard subarrays, each of the first and second guard subarrays having a physical center, each element of each of said first and second guard subarrays further having a phase and a weight associated therewith, the weight being selected for application to the signal received by the respective element, the weights associated with the elements of the first guard subarray being selected to exhibit quadrant symmetry with respect to one another, the weights of the second guard subarray being selected to exhibit quadrant symmetry with respect to one another; and means for establishing a 90-degree phase difference between the phase of the received signal at the physical center of said first guard subarray and the phase of the received signal at the physical center of said second guard subarray; and means at each element for applying the respective weight associated with that element to the signal received by that element.

* * * * *

UNITED STATES PATENT AND TRADEMARK OFFICE

CERTIFICATE OF CORRECTION

PATENT NO. : 5,047,785

DATED : September 10, 1991

INVENTOR(S) : Michael D. Julian

It is certified that error appears in the above-identified patent and that said Letters Patent is hereby corrected as shown below:

Column 1, after the title and before the heading "BACKGROUND OF THE INVENTION," insert the paragraph: -- This invention was made with Government support under Contract No. G3590-KC1D awarded by the Government. The Government has certain rights in this invention. --

Column 3, line 41, delete "v" and insert therefor -- y --.

Column 4, line 44, delete "v" and insert therefor -- y --.

Signed and Sealed this

Third Day of January, 1995

*Attest:*

BRUCE LEHMAN

*Attesting Officer*

*Commissioner of Patents and Trademarks*